US006321797B1

(12) United States Patent
Smolinski et al.

(10) Patent No.: US 6,321,797 B1
(45) Date of Patent: Nov. 27, 2001

(54) BENCH MOUNT APPARATUS FOR REMOTE TOOL HEAD

(75) Inventors: Gerald J. Smolinski, Lakeland; Lane Moultrie, Memphis, both of TN (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/574,505

(22) Filed: May 19, 2000

(51) Int. Cl.[7] ..... B21F 9/02
(52) U.S. Cl. ..... 140/93.2; 140/93 A
(58) Field of Search ..... 140/93 A, 93.2, 140/123.6; 100/33 PB; 53/138.6, 138.7

(56) References Cited

U.S. PATENT DOCUMENTS 6,112,499 * 9/2000 Lyskawa et al. ..... 140/93.2

* cited by examiner

*Primary Examiner*—Lowell A. Larson
(74) *Attorney, Agent, or Firm*—Hoffmann & Baron, LLP

(57) ABSTRACT

A bench mount apparatus for supporting the tool head of an automatic cable tie installation system in a hands free mode. The bench mount apparatus is capable of supporting the tool head in at two distinct orientations and, more preferably, is capable of providing multiple degrees of freedom for locating the jaw assembly with respect to a support surface thereby facilitating interaction between the installer and the system.

16 Claims, 6 Drawing Sheets

BENCH MOUNT APPARATUS FOR REMOTE TOOL HEAD

BACKGROUND OF THE INVENTION

The present invention relates to a bench mount apparatus and, more particularly, to a bench mount apparatus for supporting the tool head of a cable tie installation system in a hands free mode.

As is well-known to those skilled in the art, cable ties are used to bundle or secure a group of articles such as electrical wires or cables. Cable ties of conventional construction include a cable tie head and an elongate tail extending therefrom. The tail is wrapped around a bundle of articles and thereafter inserted through a passage in the head. The head of the cable tie typically supports a locking element which extends into the head passage and engages the body of the tail to secure the tail to the head.

Although cable ties are often installed manually, it is desirable in certain applications to utilize an automatic cable tie installation system wherein cable ties are dispensed from a remote dispenser, and thereafter delivered to a tool head for application about a bundle of wires positioned within the jaws of the tool head. Automatic cable ties installation systems are well-known in the art, and are disclosed for example in U.S. Pat. Nos. 4,790,225 and 4,498,506.

The tool heads of such installation systems are configured to be hand held, that is, an installer must use at least one hand to support and operate the tool head. This hand held operation of the tool head is desirable, and even preferred, in many applications.

It will be appreciated, however, that in certain applications the installer will find it beneficial to have both hands available for manipulating the elongate articles to be bundled. In these applications, it is desirable to mount the tool head of the cable tie installation system on a bench mount, and provide an operating switch, such as a foot pedal, to activate the system. Due to the large number of possible applications, together with the physical characteristics of the installer, a bench mount apparatus should provide flexibility with regard to the orientation of the jaw assembly of the tool head.

There is therefore a need in the art for a bench mount apparatus for supporting the tool head of an automatic cable tie installation system in a hands free mode wherein the bench mount apparatus is capable of supporting the tool head in at least two distinct orientations. The bench mount apparatus preferably provides multiple degrees of freedom for locating the jaw assembly with respect to a support surface, thereby facilitating the interaction between the installer and the system.

SUMMARY OF THE INVENTION

The present invention, which addresses the needs of the prior art, relates to a bench mount apparatus for supporting a tool head of an automatic cable tie installation system in a hands free mode. The apparatus includes a base configured for securement to a support surface. The base includes at least one mounting surface. The apparatus further includes a support structure for holding the tool head in a predetermined orientation. The support structure is removably securable to the mounting surface and is adapted for securement to the mounting surface in at least two orientations.

The present invention also relates to a cable tie installation system for installation of a cable tie about a bundle of articles, the cable tie including a head and an elongate tail extending therefrom. The system includes a tool head for receiving and applying the cable tie about the bundle of articles. The tool head includes jaws for surrounding the articles and directing the cable tie thereabout. The system further includes a cable tie bandolier including a plurality of cable ties. The system further includes a remote dispenser configured to sever the leading cable tie from the bandolier and propel the severed cable tie to the tool head. The system further includes a cable tie delivery hose extending between the dispenser and the tool head to provide a cable tie passage therebetween. The system further includes a bench mount for supporting the tool head in a hands free mode. The bench mount includes a power actuated mechanism for operating at least one of the jaws. The system further includes a support structure for holding the tool in a predetermined orientation. The support structure is removably securable to the mounting surface and is adapted for securement to the mounting surface in at least two orientations. The system further includes a control mechanism for operating the system in the hands free mode. The control mechanism includes a foot pedal and an electronic brain for controlling delivery of the tie by the dispenser and tensioning of the cable tie by the tool head. Finally, the tool head includes an air tap fitting whereby compressed air may be fed to the power-actuated mechanism.

As a result, the present invention provides a bench mount apparatus for supporting a tool head of an automatic cable tie installation system in a hands free mode wherein the bench mount apparatus is capable of supporting the tool head in at least two distinct orientations and, more preferably, is capable of providing multiple degrees of freedom for locating the jaw assembly with respect to a support surface thereby facilitating the interaction between the installer and the system.

DETAILED DESCRIPTION OF THE INVENTION

Figure 1:
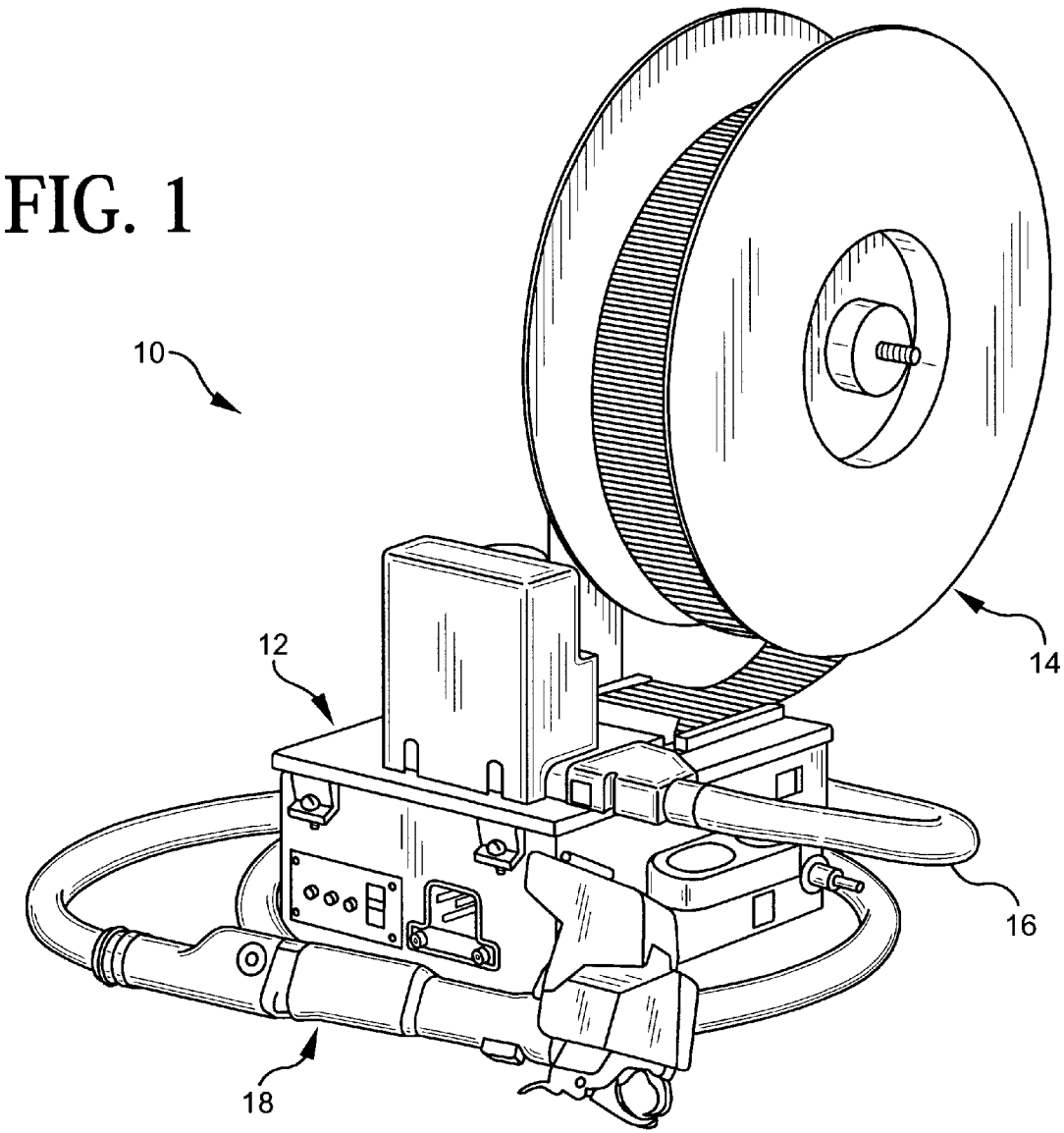
FIG. 1 is a perspective view of a cable tie installation system.

Referring now to the drawings, an automatic cable tie installation system 10 is shown in FIG. 1. Installation system 10 includes a cable tie dispenser 12 (as for example described in commonly-owned pending U.S. application Ser. No. 09/377,650 incorporated herein by reference), a cable tie bandolier 14 (as for example described in commonly-owned U.S. Pat. Nos. 5,934,465 and 5,967,316, incorporated herein by reference), a cable tie delivery hose 16 and a tool head 18. In operation, dispenser 12 severs the leading cable tie from bandolier 14, and thereafter propels the individual cable tie to the tool head via hose 16. The cable tie is wrapped about a bundle of articles positioned within the jaws, tensioned and is then subjected to a cutting operation whereby the excess portion of the cable tie tail is cut from the tensioned cable tie.

Figure 2:
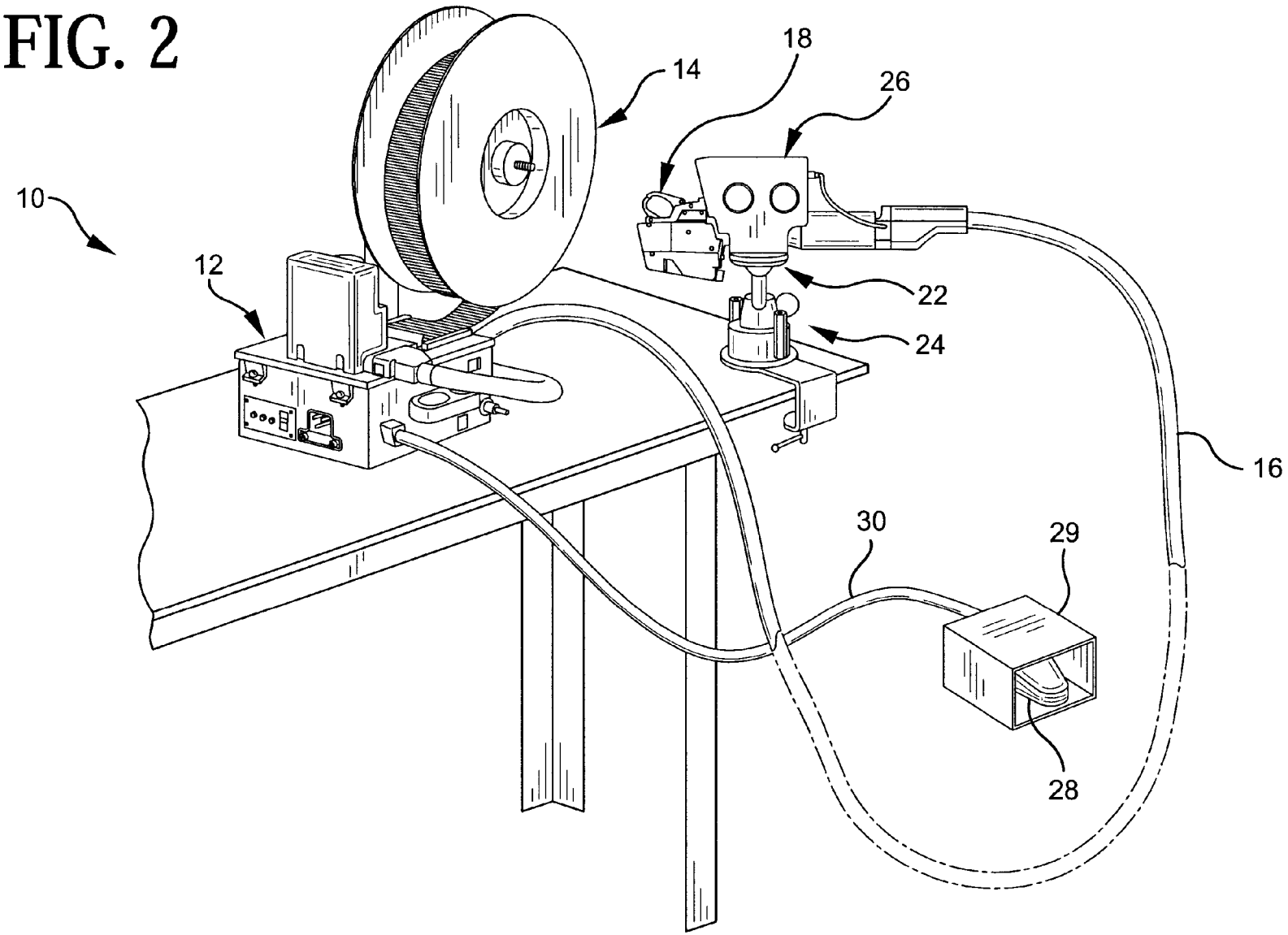
FIG. 2 is a perspective view showing the cable tie installation system of FIG. 1 in use with the bench mount apparatus of the present invention.

In accordance with the present invention, installation system 10 is adapted for use with a bench mount apparatus 22 (see FIG. 2). In this regard, bench mount apparatus 22 includes a base 24, a support structure 26 and a foot pedal 28 located within a rectangular housing 29 and connected to cable tie dispenser 12 via a cable 30.

Figure 3:
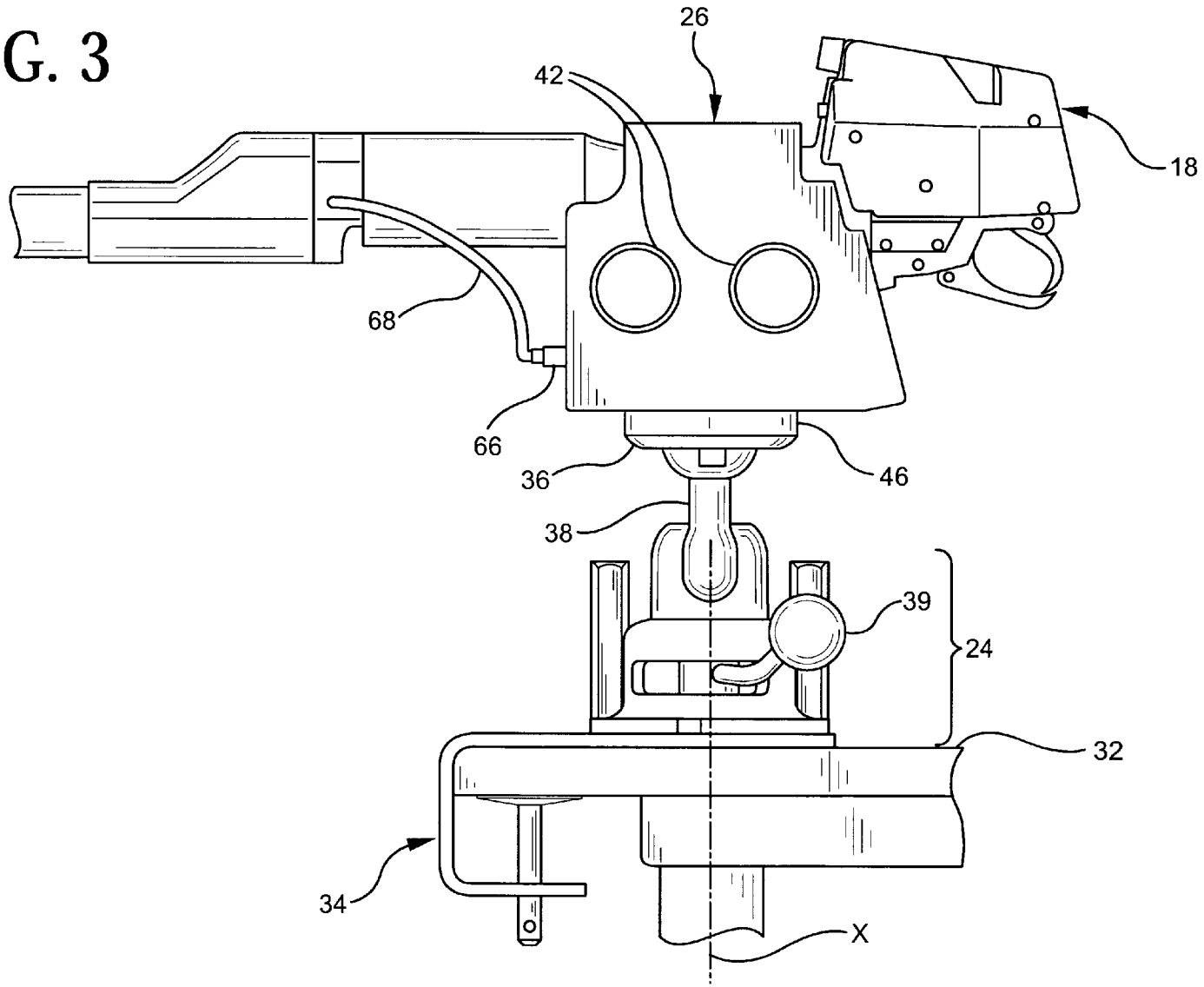
FIG. 3 is an elevational view showing the tool head of the cable tie installation system supported by the bench mount apparatus in a first orientation.

Referring now to FIG. 3, base 24 is configured for securement to a support surface 32 via a clamp 34. Of course, base 24 can be secured to support surface 32 in any known manner including the use of conventional hardware, brackets, welding, etc. Base 24 includes a mounting surface 36. Mounting surface 36 is located at one end of a movable shaft 38. In this regard, shaft 38 is angularly movable between an orientation perpendicular to support surface 32 (as shown in FIG. 3) to an orientation parallel to support surface 32, i.e., shaft 38 is angularly rotatable through a 90° arc (in a plane normal to the sheet of FIG. 3). In addition, shaft 38 is preferably rotatable through 360° of rotation with respect to an axis X, which is perpendicular to support surface 32 and passes through shaft 38 when shaft 38 is oriented perpendicular to support surface 32. Base 24 is preferably provided with an adjustment knob 39 movable between a first release position wherein both the angular and circular orientation of shaft 38 may be adjusted and a second locking position wherein the orientation of shaft 38 is fixed with respect to support surface 32.

Figure 4:
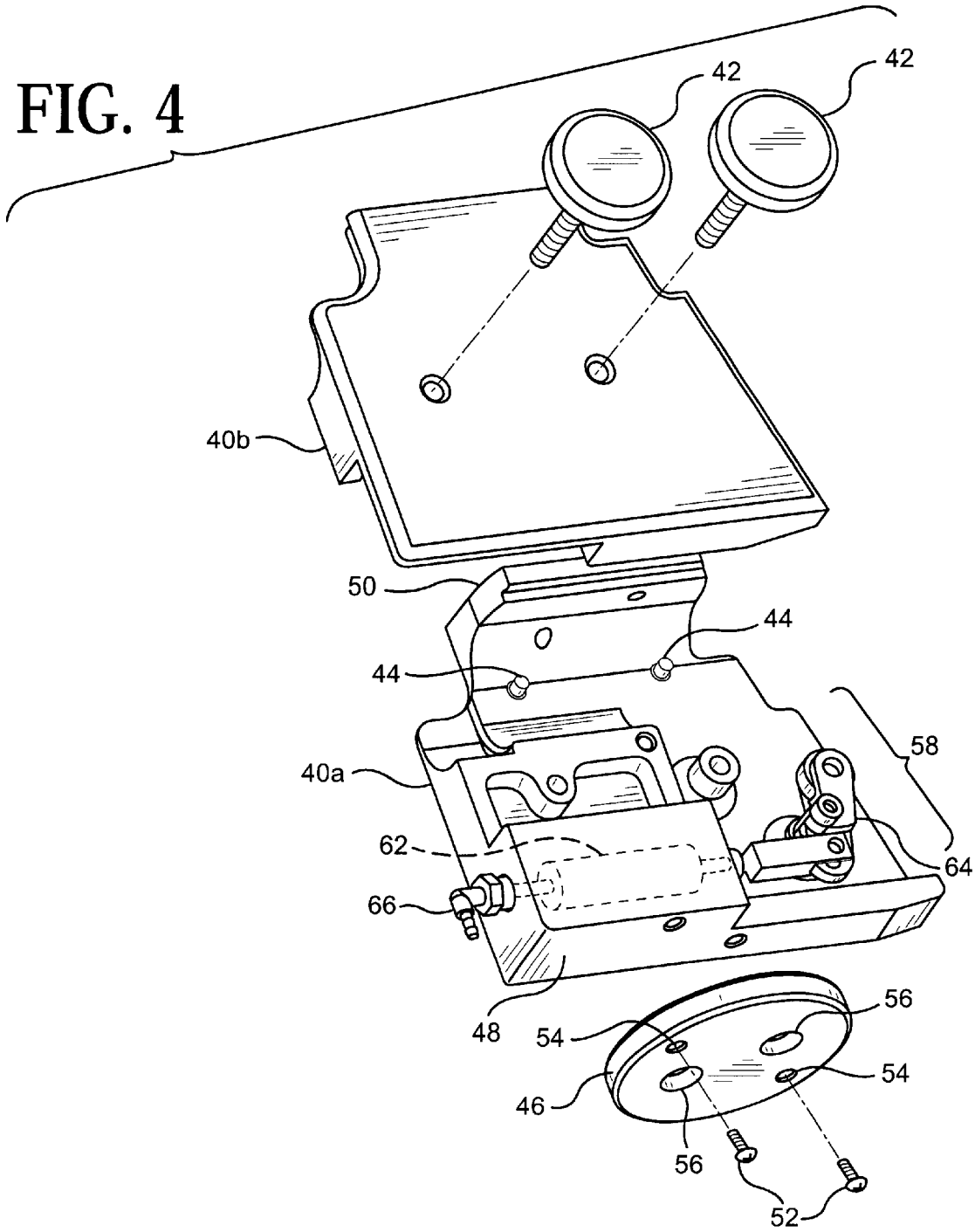
FIG. 4 is an exploded perspective view of the support structure of the bench mount apparatus.

As mentioned, bench mount apparatus 22 also includes a support structure 26 for holding tool head 18 in a predetermined orientation. As will be explained further hereinbelow, the support structure is removably securable to mounting surface 36 and it adapted for securement to mounting surface 36 in at least two orientations. Particularly, support structure 26 includes first and second cooperating housing shells 40*a*, 40*b* (see FIG. 4), configured to surround and support tool head 18 therebetween. In this regard, the housing shells 40*a*, 40*b* are removably securable to one another via a pair of clamping knobs 42. Housing shell 40*a* preferably includes a pair of locating pins 44 which engage a pair of guide holes formed in the housing of tool head 18, thus ensuring that tool head 18 is properly located within housing shells 40*a*, 40*b*.

Although housing shells 40*a*, 40*b* are configured to receive tool head 18 in only a single orientation, the novel design of support structure 26 provides two distinct mounting orientations on base 24. This is accomplished via a mounting disc 46, which may be secured to either surface 48 or surface 50 of support structure 26. In this regard, each of surfaces 48, 50 includes a pair of threaded holes sized to receive a pair of screws 52 extending through apertures 54 of mounting disc 46. Accordingly, support structure 26 can be secured to mounting disc 46 in one of two orientations.

Figure 5:
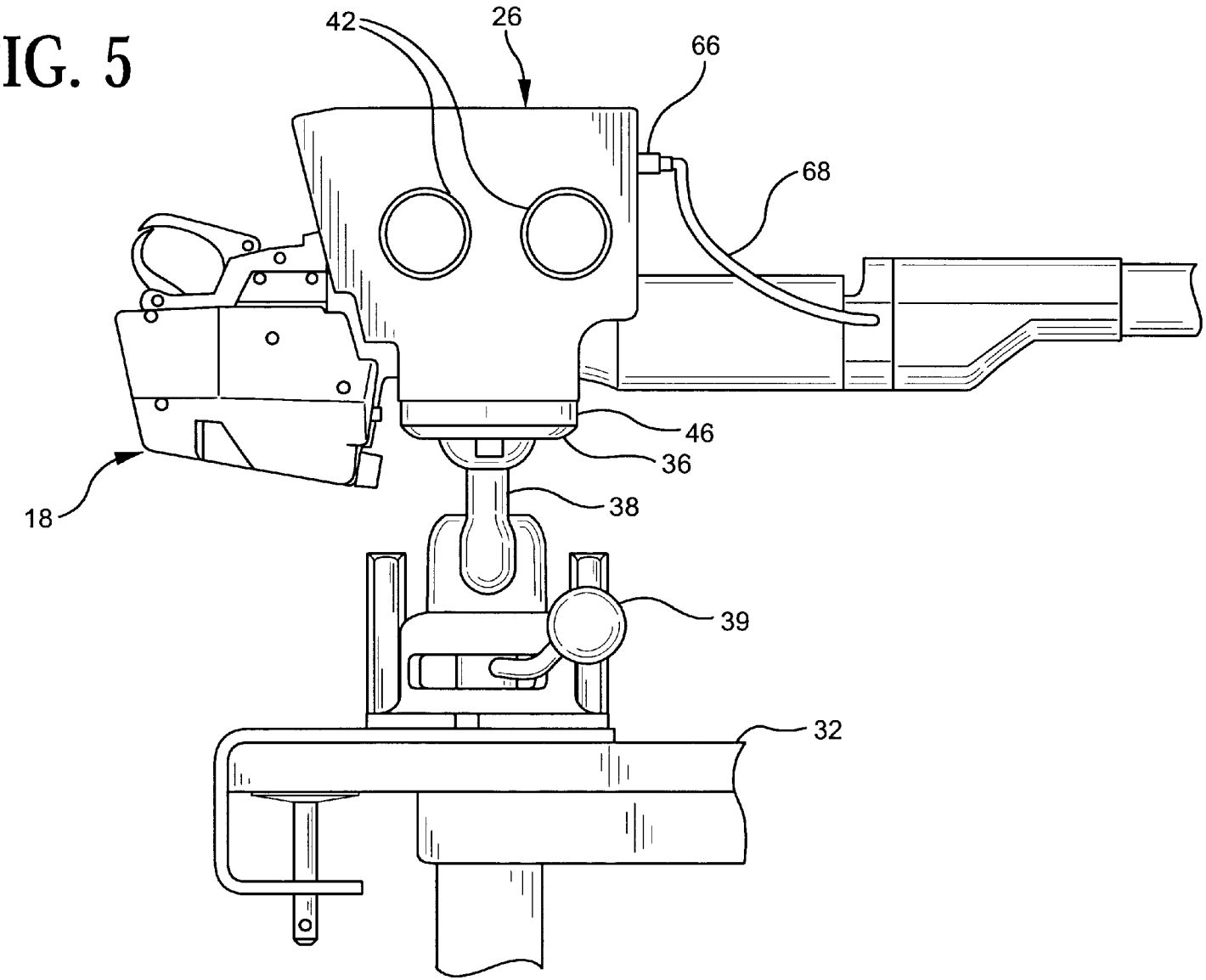
FIG. 5 is an elevational view showing the tool head of the cable tie installation system supported by the bench mount apparatus in a second orientation.

Thereafter, mounting disc 46 is attached to mounting surface 36 via a pair of nuts and bolts (not shown) extending through apertures 56 of mounting disc 46. As a result, when mounting disc 46 is secured to surface 48 tool head 18 can be supported in a first orientation wherein the jaw assembly is directed downward towards support surface 32 (see FIG. 3), and when mounting disc 46 is secured to surface 50 tool head 18 can be supported in a second orientation wherein the jaw assembly is directed upward away from support surface 32 (see FIG. 5).

Figure 6:
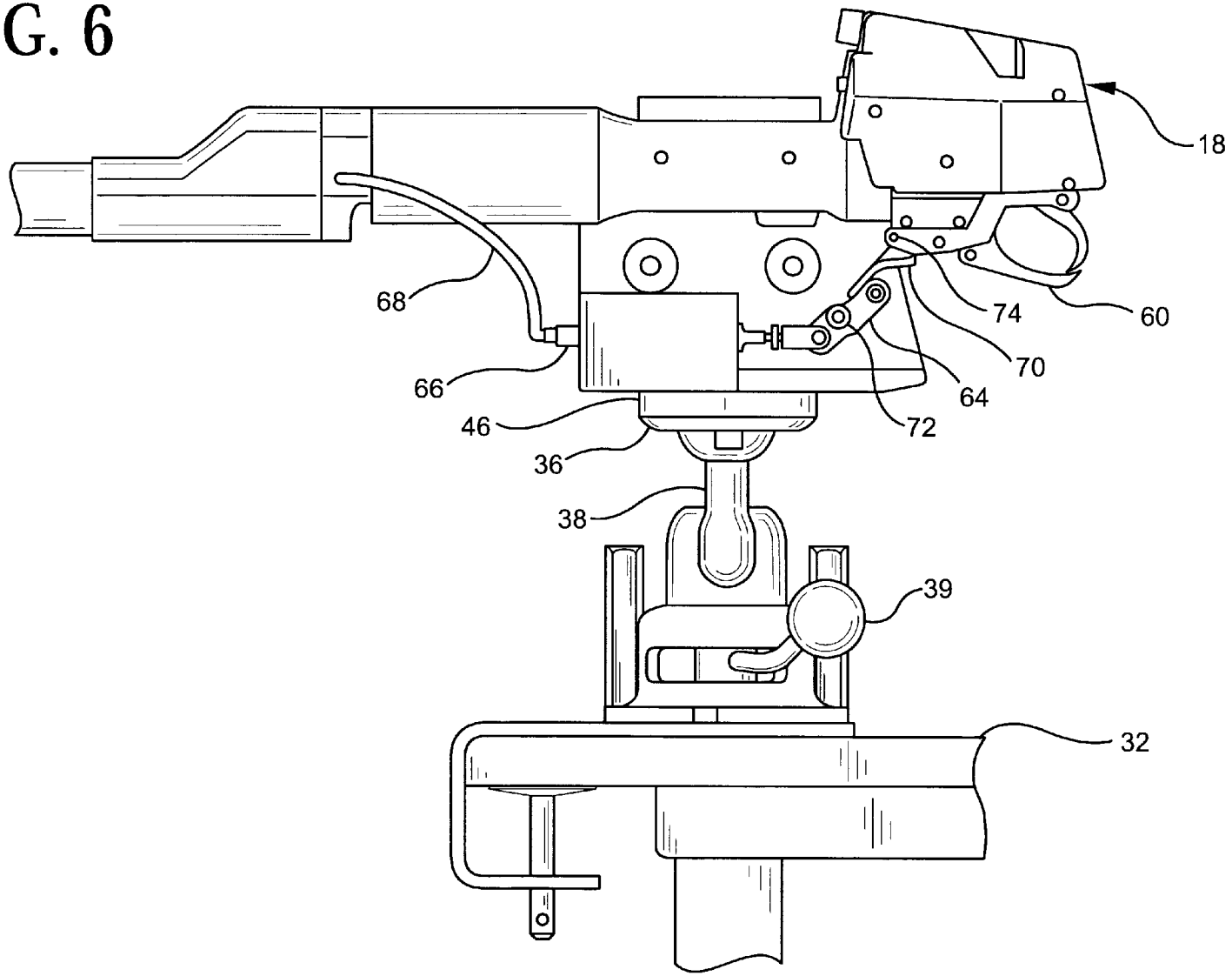
FIG. 6 is an elevational view showing the tool head of the cable tie installation system supported by the bench mount apparatus wherein one of the housing shells of the support structure has been removed.

Referring back to FIG. 4, housing shell 40*a* of support structure 26 includes a power actuated mechanism 58 configured to operate lower jaw component 60 of tool head 18 (see FIG. 6). In this regard, power actuated mechanism 58 includes a pneumatic actuator 62 and a linkage assembly 64. A pneumatic fitting 66, which is in fluid communication with pneumatic actuator 62, is located on an external surface of support structure 26. A second pneumatic fitting (not shown) is located on tool head 18. An air line 68 (see FIGS. 3 and 5–6) extends between fitting 66 and the second fitting located on tool head 18, and is operational when tool head 18 is used with bench mount apparatus 22 in the hands free mode thus allowing compressed air to be supplied to pneumatic actuator 62. Of course, it is contemplated herein that other arrangements could be employed to operate the lower jaw component of tool head 18 including an electrical motor, a gear driven mechanism, etc.

Referring now to FIG. 6, linkage assembly 64 cooperates with trigger 70 of tool head 18. The jaws of tool head 18 are normally closed. When the tool head is mounted on the bench mount apparatus and the system is powered on, actuator 62 will cause linkage 64 to pivot counterclockwise about pin 72, thus causing trigger 70 to pivot clockwise about pin 74, which in turn causes lower jaw component 60 to pivot to an open position. The system is now in a stand-by mode, with the jaw assembly ready to receive a bundle of elongate articles.

In operation, an installer presses foot pedal 28 to begin the installation process. (When tool head 18 is used in the hands free mode with bench mount apparatus 22, the manual operating switch located on the tool head is bypassed). Once foot pedal 28 is depressed, pneumatic actuator 62 releases trigger 70, thus allowing the jaw assembly to return to its normally closed orientation shown in FIG. 6. Thereafter, the cable tie dispenser initiates a normal cycle wherein the leading cable tie is severed from cable tie bandolier 14 by dispenser 12, and thereafter propelled through delivery hose 16 of tool head 18, where it is wrapped about the bundle of elongate articles located in the jaw assembly, tensioned and cut. Finally, lower jaw 60 is reopened via power-actuated mechanism 58 to allow the installer to remove the bundled articles.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendment and/or deviations be included within the scope of the followings claims.

What is claimed is:

1. A bench mount apparatus for supporting a tool of an automatic cable tie installation system in a hands-free mode, comprising:

a base configured for securement to a surface, said base including at least one mounting surface;

a support structure for holding said tool head in a predetermined orientation, said support structure being removably securable to said mounting surface and being adapted for securement to said mounting surface in at least two orientations.

2. The bench mount apparatus according to claim 1, further comprising a mounting disk configured for securement to said mounting surface, said mounting disk being removable securable to said support structure in at least two locations.

3. The bench mount apparatus according to claim 1, wherein said support structure includes cooperating first and second housing shells configured to surround and support said tool head therebetween.

4. The bench mount apparatus according to claim 3, wherein at least one of said housing shells includes a pair of locating pins for locating said tool head with respect to said housing shells.

5. The bench mount apparatus according to claim 4, further comprising a pair of clamping knobs for securing said housing shells to one another.

6. The bench mount apparatus according to claim 3, wherein said base includes a clamp for securing said base to said support surface.

7. The bench mount apparatus according to claim 1, wherein said base includes a movable shaft, and wherein said mounting surface is located at one end of said shaft.

8. The bench mount apparatus according to claim 7, wherein the other end of said shaft is coupled to said base such that said shaft is rotatable through 360° of rotation and is angularly movable with respect to said support surface.

9. The bench mount apparatus according to claim 1, further comprising a power-actuated mechanism adapted for operating a jaw component of said tool head, said power-actuated mechanism being located within said support structure.

10. The bench mount apparatus according to claim 9, wherein said power-actuated mechanism includes a pneumatic actuator and a linkage assembly.

11. The bench mount apparatus according to claim 10, further comprising a fitting secured to an external surface of said support structure, said fitting communicating with said pneumatic actuator.

12. The bench mount apparatus according to claim 1, further comprising a control mechanism for operating said tool head in said hands-free mode, said control mechanism including a foot pedal.

13. A cable tie installation system for installation of a cable tie about a bundle of articles, said cable tie including a head and an elongate tail extending therefrom, comprising:

a tool head for receiving and applying said cable tie about said bundle of articles, said tool head including jaws for surrounding said articles and directing said cable tie thereabout;

a cable tie bandolier including a plurality of said cable ties;

a remote dispenser configured to sever the leading cable tie from said bandolier and propel said severed cable tie to said tool head;

a cable tie delivery hose extending between said dispenser and said tool head to provide a cable tie passage therebetween;

a bench mount for supporting said tool head in a hands-free mode, said bench mount including a power-actuated mechanism for operating at least one of said jaws;

a support structure for holding said tool head in a predetermined orientation, said support structure being removably securable to a mounting surface and being adapted for securement to said mounting surface in at least two orientations;

a control mechanism for operating said system in said hands-free mode, said control mechanism including a foot pedal and an electronic brain for controlling delivery of said tie by said dispenser and tensioning of said cable tie by said tool head; and wherein said tool head includes an air tap fitting whereby compressed air may be fed to said power-actuated mechanism.

14. the system according to claim 13, further comprising an air line extending between said air tap fitting on said tool head and power-actuated mechanism.

15. The system according to claim 13, wherein said power-acuated mechanism includes a pneumatic actuater and a linkage assembly.

16. The system according to claim 13, wherein said bench mount provides multiple degrees of freedom for said tool head in said hands-free mode.

* * * * *